US005094460A

United States Patent [19]

Morse et al.

[11] Patent Number: 5,094,460

[45] Date of Patent: Mar. 10, 1992

[54] AIRLINE TRAVEL BOARD GAME

[76] Inventors: Stephen D. Morse, 4314 Valhalla; Moira B. McBride, P.O. Box 1681, both of Sitka, Ak. 99835; Sherry L. Levesque, P.O. Box 2146, Flagstaff, Ariz. 86003

[21] Appl. No.: 556,163

[22] Filed: Jul. 20, 1990

[51] Int. Cl.[5] ..... A63F 3/04

[52] U.S. Cl. ..... 273/254

[58] Field of Search ..... 273/242, 243, 251, 252, 273/254, 240

[56] References Cited

U.S. PATENT DOCUMENTS

| | | | |
|---|---|---|---|
| 495,509 | 4/1983 | Neilson . | |
| 707,469 | 8/1902 | Wayts | 273/254 |
| 989,209 | 4/1911 | Tucker | 273/254 |
| 1,451,511 | 4/1923 | Jones . | |
| 2,145,394 | 1/1939 | Hobbs et al. | 273/252 X |
| 3,638,946 | 2/1976 | Bain . | |
| 4,093,235 | 6/1978 | Barry | 273/254 |
| 4,283,059 | 8/1981 | Beeder | 273/254 |
| 4,377,287 | 3/1983 | Erwin | 273/252 |
| 4,411,432 | 10/1983 | Stevens | 273/251 |
| 4,679,798 | 7/1987 | Dvorak et al. | 273/254 |
| 4,784,394 | 11/1988 | Sumin | 273/254 X |
| 4,966,372 | 10/1990 | Robison | 273/252 |

FOREIGN PATENT DOCUMENTS

| | | | |
|---|---|---|---|
| 2263798 | 10/1975 | France | 273/254 |
| 2280410 | 2/1976 | France | 273/254 |
| 29831 | of 1897 | United Kingdom | 273/254 |
| 2196863 | 5/1988 | United Kingdom | 273/254 |
| 2208269 | 3/1989 | United Kingdom | 273/251 |

OTHER PUBLICATIONS

Selected U.S. Government Publications, *Safety Belt Game*, Mar. 1974, p. 10.

*Primary Examiner*—Edward M. Coven
*Assistant Examiner*—William E. Stoll
*Attorney, Agent, or Firm*—Christensen, O'Connor, Johnson & Kindness

[57] ABSTRACT

An airline travel board game for use by at least two players to accumulate bonus mileage and monetary status, and a method of playing the same. The airline travel board game includes a game board (10) having a playing surface (12) provided with a plurality of interconnected spaces (18), some of the spaces bearing the names of geographical locations and some bearing directional commands. A plurality of instruction cards (70, 76, and 82) associated with certain of the spaces of the game board, in conjunction with the spaces bearing directional commands, may dictate a change in a player's position on the game board, a change in a player's monetary status and/or a change in a player's total bonus mileage. Thus, real life trials and tribulations associated with air travel are simulated during play. Preferably, the players consecutively take turns until one player has accumulated a predetermined amount of bonus mileage required to win the game.

12 Claims, 7 Drawing Sheets

AIRLINE TRAVEL BOARD GAME

TECHNICAL FIELD

This invention relates to board games and, more specifically, to air travel board games.

BACKGROUND OF THE INVENTION

Air travel has always been an adventure. The traveler is often beset by a variety of obstacles beyond his control. With the advent of frequent-flyer bonus mileage, the complications of air travel have only increased.

Air travel games involving the accumulation of mileage as playing pieces are moved about a game board are known. Many such games deal with the accumulation of actual travel mileage between locations arranged on the game board in a pattern that corresponds to their relative geographical locations. Actual travel mileage is indicated directly on the game board adjacent lines extending between locations.

However, no game apparatuses have apparently been provided where travel occurs between locations randomly situated on the game board, where bonus mileage rather than actual mileage is accumulated, where a mileage chart is used to calculate the bonus mileage earned when travelling between locations, and where the situational trials and tribulations of air travel are also experienced during play. This invention is aimed at providing such a game board apparatus.

SUMMARY OF THE INVENTION

In accordance with this invention, an airline travel board game for use by at least two players to accumulate bonus mileage and monetary status, and a method of playing the same, are disclosed. The airline travel board game includes a game board having a playing surface provided with a plurality of spaces, some of the spaces bearing the names of geographical locations and some bearing directional commands. A playing piece associated with each player is used to designate the player's position about the spaces of the game board. A chance number indicator, preferably a die, is used during each player's turn to indicate a chance number that determines the initial movement of the player's playing piece.

A plurality of instruction cards associated with certain of the spaces of the game board, in conjunction with the spaces bearing directional commands, may dictate a change in a player's position on the game board, a change in a player's monetary status and/or a change in a player's total bonus mileage. Thus, real life trials and tribulations associated with air travel are simulated during play.

A mileage chart is employed for calculating bonus mileage earned by a player when moving from one space bearing the name of a geographical location to another space bearing the name of a geographical location. A mileage record for keeping each player's current total bonus mileage during play is used. Each player's monetary status is measured with playing money. Preferably, the players consecutively take turns until one player has accumulated a predetermined amount of bonus mileage required to win the game.

In accordance with another aspect of the present invention, at least one commuter circle is situated among the spaces of the game board. The commuter circle is made up of commuter location spaces bearing the names of geographical locations that are more proximate than the geographical locations appearing on some of the spaces of the game board. Accordingly, the potential for earning bonus mileage is reduced when traveling within the commuter circle.

BRIEF DESCRIPTION OF THE DRAWINGS

The foregoing and other features and advantages of the present invention will become more readily appreciated as the same becomes better understood by reference to the following detailed description of the preferred embodiment of the invention when taken in conjunction with the accompanying drawings, wherein.

DETAILED DESCRIPTION OF THE PREFERRED EMBODIMENT

An airline travel board game made in accordance with the principles of the present invention is described below. In short, the airline travel board game is designed for use by at least two players to accumulate bonus mileage and monetary status. Preferably, the players consecutively take turns until one player has accumulated a predetermined amount of bonus mileage necessary to win the game. Each player's turn begins with an initial movement on a game board determined by a chance number. Various spaces on the game board, and various instruction cards associated with certain spaces, may dictate a change in a player's position on the game board, a change in a player's monetary status and/or a change in a player's total bonus mileage during play.

Figure 1:
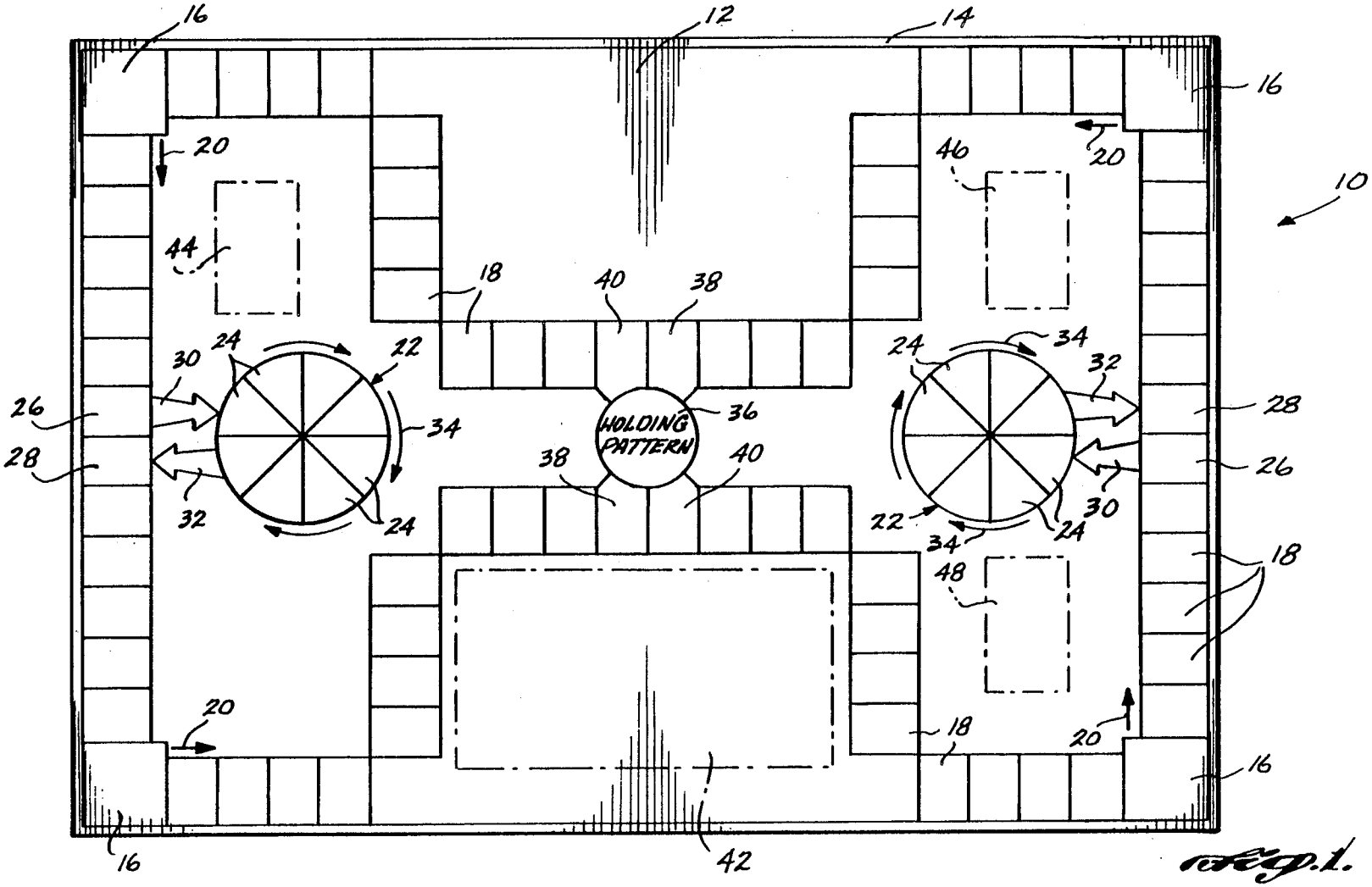
FIG. 1 is a plan view of a game board made in accordance with the principles of the present airline travel board game invention.

Referring to FIG. 1, an airline travel board game made in accordance with the principles of the present invention includes a thin rectangular game board 10 having a playing surface 12 upon which play is conducted. Around the perimeter of the playing surface 12 is located a narrow border 14. A substantially square home space 16 is situated in each of the four corners of the game board 10, each home space 16 bearing the name of a city and having a unique color. A plurality of rectangular interconnected spaces 18, smaller in dimension than home spaces 16, extend between the home spaces 16 around the perimeter and into the central region of the game board 10. The home spaces 16 and interconnected spaces 18 are arranged on the game board 10 in a pattern roughly resembling an airline terminal. A directional arrow 20 is located adjacent each home space 16 to indicate that movement around the game board 10 occurs in a counterclockwise direction. The varied physical and functional characteristics of the interconnected spaces 18 are more fully described below.

A commuter circle 22, made up of a plurality of commuter location spaces 24, is situated at each end of the game board 10. Each commuter circle 22 also includes a commuter circle entrance space 26 and a commuter circle exit space 28, which are situated among the interconnected spaces 18 along the perimeter of each end of the game board 10. Commuter circle entrance space 26 represents a commuter airline travel counter and is known as a "Commuter Counter." When a player lands on commuter circle entrance space 26, he must travel completely around the commuter circle 22. The first counted space beyond entrance space 26 is the commuter location space 24 adjacent an entrance arrow 30. The player exits the commuter location spaces 24 of the commuter circle 22 at the commuter location space adjacent an exit arrow 32. Similarly, exit arrow 32 does not count as a space. A series of directional arrows 34 are located around the commuter circle 22 to indicate that movement around the commuter circle occurs in a clockwise direction. More detail regarding the commuter circle is provided below.

Figure 2:
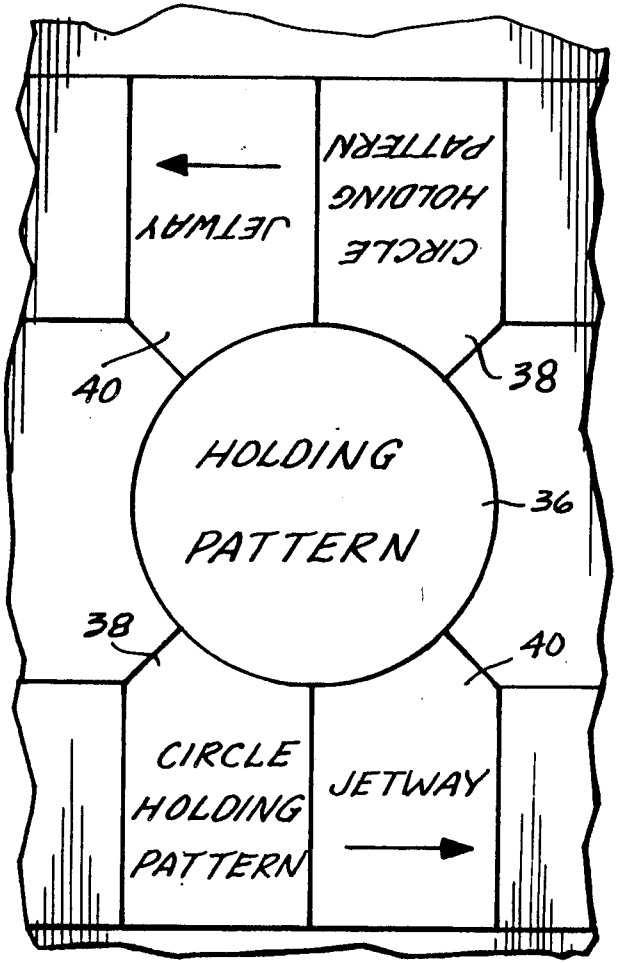
FIG. 2 is an enlarged detail view of the holding pattern of the game board shown in FIG. 1.

A circular holding pattern 36 (see FIGS. 1 and 2) is situated at the approximate center of the game board 10. A holding pattern entrance space 38 is situated on each side of holding pattern 36. Each holding pattern entrance space 38 bears the directional command "Circle Holding Pattern," which directs the player to a position within the holding pattern 36 should he land on the holding pattern entrance space. A holding pattern exit space 40, located adjacent holding pattern entrance space 38, is also provided on each side of the holding pattern 36. The holding pattern exit space 40 bears the word "Jetway" and an arrow, which directs the player to advance to the interconnected space 18 on the opposite side of holding pattern exit space 40 from holding pattern entrance space 38 when exiting the holding pattern 36. While the holding pattern exit space 40 does not count as a space during exit from the holding pattern 36, it does count as a space during normal travel around the interconnected spaces 18 of the game board 10.

A mileage chart 42 (see FIG. 1) is situated on the playing surface 12 of game board 10 at a location between the holding pattern 36 and the border 14. The mileage chart 42 may actually be printed on the playing surface 12, thereby being integral with the game board 10. Alternatively, a nonintegral mileage chart 42 may simply be placed on the playing surface 12 at the location indicated in FIG. 1. If so, the area occupied by the mileage chart 42 may bear a different color than the playing surface 12, or an outline may be used, to indicate the preferred location of the mileage chart. Further detail regarding the mileage chart 42 is provided below.

Three decks of cards 44, 46, and 48 (see FIG. 1) are positioned upon the playing surface 12 at locations near the commuter circles 22 in the area interior to interconnected spaces 18. These three decks of cards are decks of destination cards, situation cards, and commuter cards, respectively. As will be more fully described below, one of these cards is drawn by a player when initially landing upon an interconnected space 18 that is designated as a destination space, situation space, or commuter space, respectively.

Figure 3:
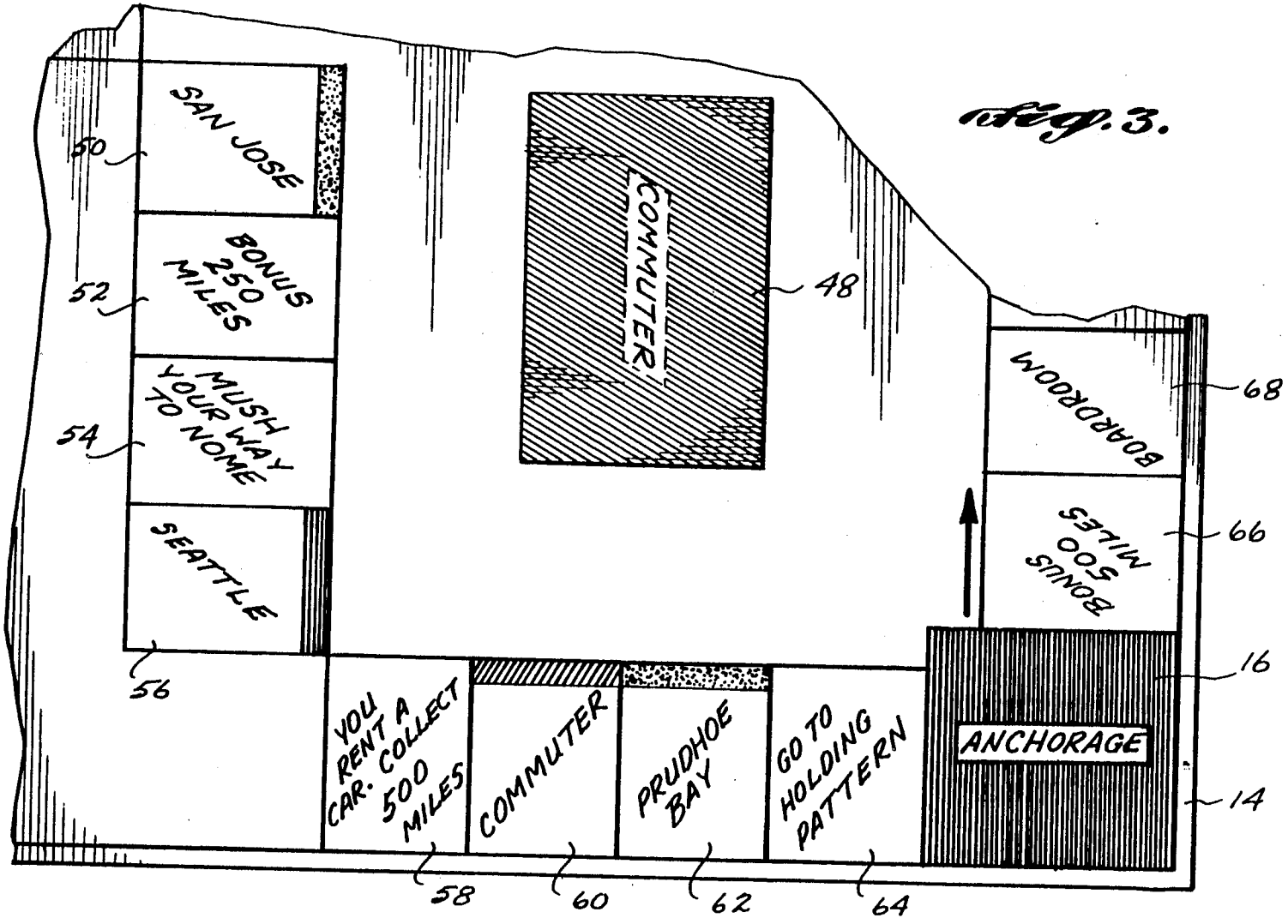
FIG. 3 is an enlarged detail view of the lower right corner of the game board shown in FIG. 1.

Referring to FIG. 3, the lower right corner of the game board 10 illustrated in FIG. 1 has been enlarged to aid in describing the various types of interconnected spaces 18. A representative arrangement of spaces 50, 52, 54, 56, 58, 60, 62, 64, 66, and 68 is shown. Spaces 50 (San Jose) and 62 (Prudhoe Bay) represent destination spaces. Destination spaces bear the name of a unique city and are identified by a band of a first color running horizontally across the top of the space. Space 56 (Seattle) represents a situation space. Each situation space bears the name of a unique city and is identified by a band of a second color extending horizontally across the top of the space. The cities depicted on destination spaces and situation spaces are randomly situated around the game board 10, with no specific correlation to actual geographical location. Space 60 represents a commuter space. Commuter spaces bear the word "Commuter" and are identified by a band of a third color extending horizontally across the top of the space. It should be noted that the cross hatching illustrated in FIG. 3 is not meant to correspond to standard PTO color cross hatching. It is only required that these three types of spaces bear three different colors. For example, the destination spaces may be green, the situation spaces yellow, and the commuter spaces blue.

Remaining spaces 52, 54, 58, 64, 66, and 68 illustrated in FIG. 3 are known as miscellaneous spaces. Miscellaneous spaces have no colored band. They may bear directional commands that dictate a change in position on the game board 10 (spaces 54 and 64) or a change in total bonus mileage (spaces 52, 58 and 66) for the player landing on such a space. Additionally, there may be miscellaneous spaces bearing the designation "Boardroom." No change in position or total bonus mileage occurs when a player lands on a space marked Boardroom. It is simply a space denominating a position to which a player may be sent in accordance with aspects of the airline travel board game of the present invention to be later described.

Figure 4:
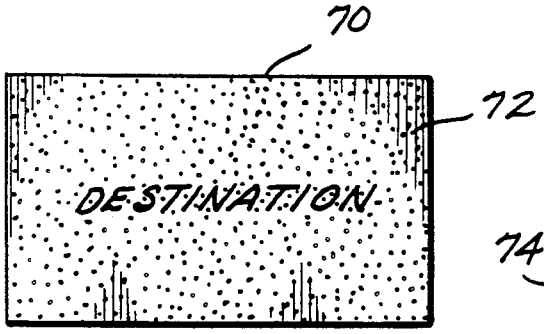
FIGS. 4 and 5 illustrate both sides of a sample destination card used in the airline travel board game of the present invention.
Figure 5:
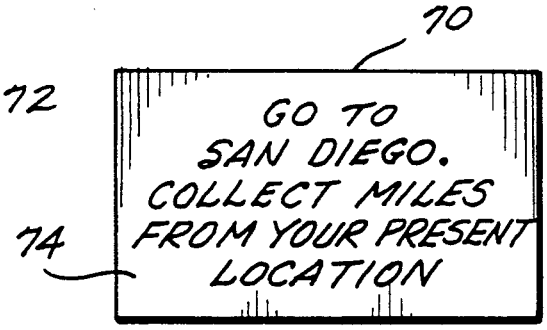

Referring to FIGS. 4 through 9, both sides of a representative sample card from each of the three decks of cards 44, 46, and 48 are illustrated. FIGS. 4 and 5 illustrate a rectangular destination card 70 of the type drawn each time a player lands on a destination space during the initial move of his turn. A first side 72 of the destination card, the side that faces up when positioned on the playing surface 12 of the game board 10, is colored to match the colored band of the destination spaces and bears the word "Destination." A second side 74 of the destination card bears a directional command that usually dictates a change in position on the game board 10 for the player drawing the card, or for another player. A change in monetary status and/or a change in total bonus mileage may also be dictated for the player drawing the card. The following are examples of directional commands appearing on the destination cards 70:

1. Go to holding pattern.
2. Send player of your choice to Prudhoe Bay. Do not collect miles.
3. Send player on your left to Anchorage. Collect no mileage.

4. Go to San Diego. Collect miles from your present location.
5. Cabin fever strikes! Roll die to see where you go.
6. Go to Fairbanks. Pay $500 for a ticket and expenses.
7. TRIPLE MILEAGE CARD-you may keep this card and use it only once to triple your mileage.
8. INSTRUMENT RATING CARD-you may keep this card and use it to get out of the holding pattern.
9. You have a sudden desire to see Orca the whale. Pay $450 for a ticket to San Diego and collect miles from your point of departure.

Figure 6:
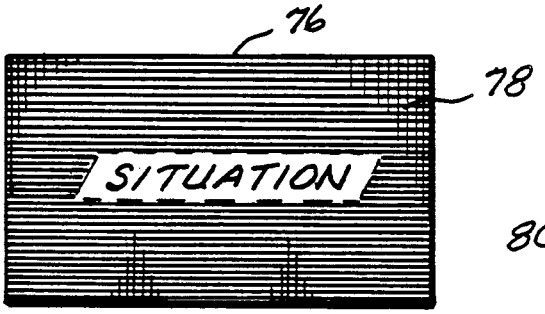
FIGS. 6 and 7 illustrate both sides of a sample situation card used in the airline travel board game.
Figure 7:
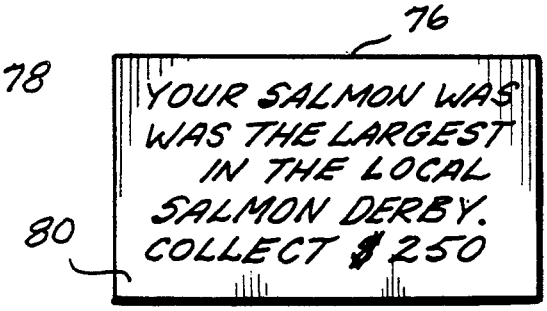

FIGS. 6 and 7 illustrate a rectangular situation card 76, which is drawn each time a player lands on a situation space during the initial move of his turn. A first side 78 of the situation card, the side that faces up when positioned on the playing surface 12 of the game board 10, is colored to match the colored band of the situation spaces and bears the word "Situation". A second side of the situation card bears a directional command that usually dictates a change in monetary status for the player drawing the card, or for another player. A change in position on the game board 10 and/or a change in total bonus mileage for any player may also be dictated. While situation cards may bear some of the same general types of directional commands as destination cards, they more likely dictate a change in monetary status. In contrast, destination cards more likely dictate a change in position. The following are examples of directional commands appearing on the situation cards 76:

1. Your travel agent has misbooked you. Pay an additional $100 for next class of seating.
2. Your salmon was the largest in the local Salmon Derby. Collect $250.
3. Your spouse just bought new designer luggage for your upcoming trip. Pay $400.
4. Using your metal detector on the Mendenhall Glacier, you find three old coins. Collect $500 for selling them.
5. It's the opera season in San Francisco. Pay $200 for a weekend in the city. Collect the miles from your point of departure.
6. Your daughter needs a new prom dress. Pay $300 for a shopping trip to San Francisco. Go there and collect miles from point of departure.
7. You wine and dine a business associate in Seattle. Forfeit $100 to cover what your expense account won't cover.
8. You spend a week snowed in upriver from Nome. Roll die, and multiply the number times $100 to determine the amount you bribed the private pilot to get you out.
9. Receive $50 from each of the other players for giving travel advice.

Figure 8:
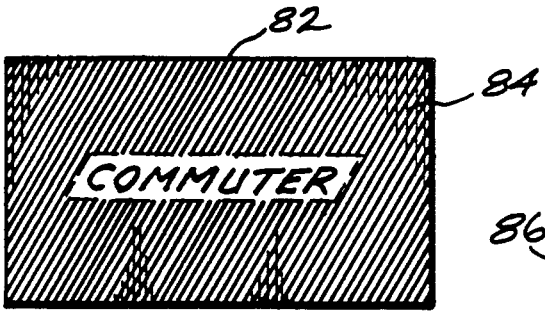
FIGS. 8 and 9 illustrate both sides of a sample commuter card used in the airline travel board game.
Figure 9:
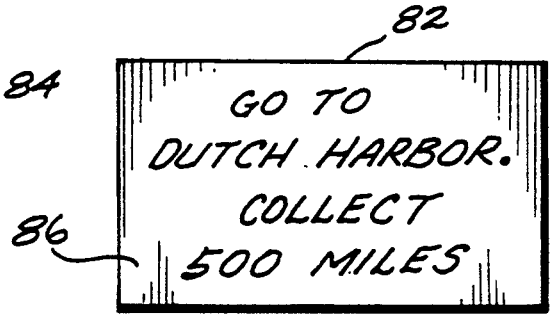

FIGS. 8 and 9 illustrate a rectangular commuter card 82, which is drawn each time a player lands on a commuter space during the initial move of his turn. A first side 84 of the commuter card, the side that faces up when positioned on the playing surface 12 of the game board 10, is colored to match the colored band of the commuter spaces and bears the word "Commuter." A second side 86 of the commuter card bears a directional command that may direct any player, but usually the player drawing the card, to a commuter circle entrance space 26 or to a particular commuter location space 24 within either of the commuter circles 22. The directional commands on the commuter cards 82 may also dictate a change in monetary status or a change in total bonus mileage for the player drawing the card. The following are examples of directional commands appearing on the commuter cards 82:

1. Bump player of your choice to commuter airline of your choice.
2. Go to Arctic Air travel counter. Start travel around the circle on your next turn. Collect 500 bonus miles when completing circle.
3. Go to Missoula. Collect 500 miles.
4. Go to Dutch Harbor. Collect 500 miles.
5. Go to Sunset Air travel counter. Start travel around circle on your next turn. Do not collect any mileage.
6. There is a family reunion this summer in Walla Walla. You buy an Ultra-Saver for $250. Go to Walla Walla and have a good time.

Figure 10:
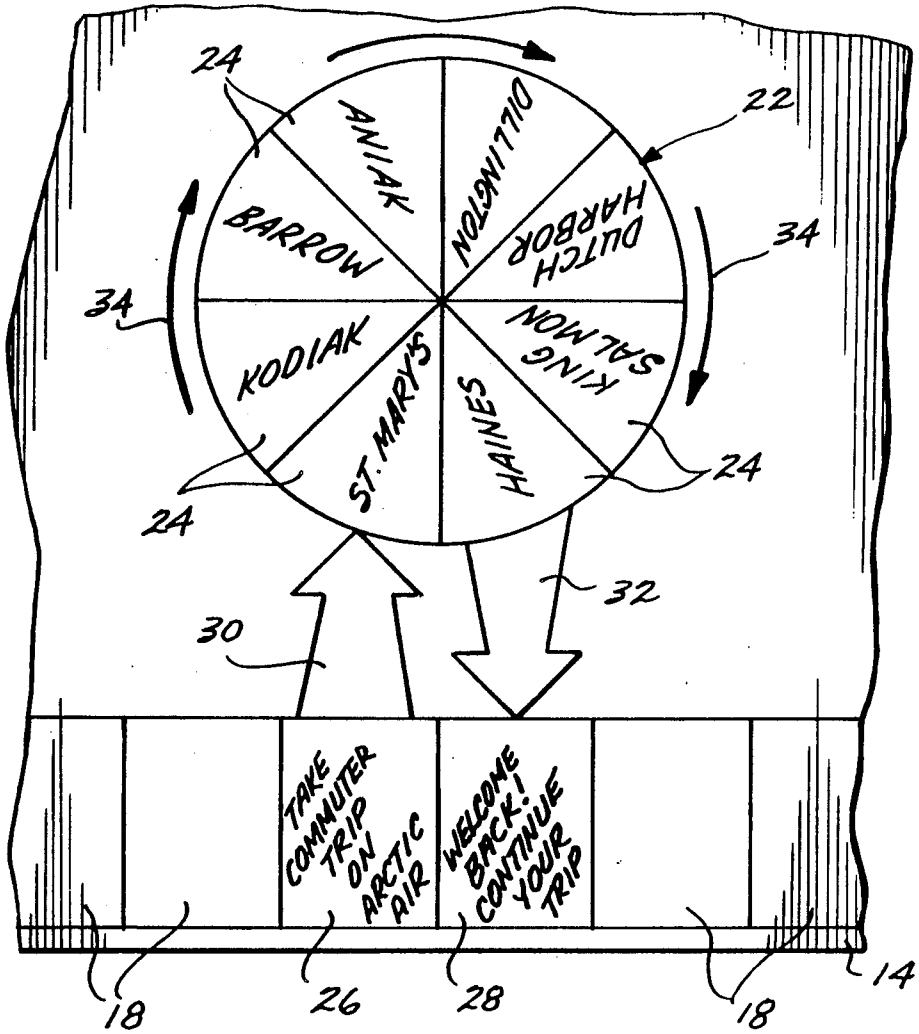
FIG. 10 is an enlarged detail view of one of the commuter circles of the game board shown in FIG. 1.

One of the two commuter circles 22 is illustrated in FIG. 10. As shown, the circle is divided into eight segments, each segment forming a commuter location space 24 bearing the name of a city that is relatively proximate in distance to the other seven cities of the commuter circle. In contrast, the distance between the cities designated on the destination and situation spaces is much greater. The illustrated commuter circle 22 of FIG. 10 contains the names of relatively proximate cities in the state of Alaska. Accordingly, the commuter circle entrance space 26 bears the words, "Take Commuter Trip on Artic Air." Because entrance arrow 30 and exit arrow 32 are not counted as spaces, the first counted space beyond the commuter circle entrance space 26 is the "St. Mary's" commuter location space 24. "Haines" is the last commuter location space 24 on the illustrated commuter circle 22. Thus, the next counted space is the commuter circle exit space 28, which bears the message "Welcome back! Continue your trip." A second similar commuter circle 22 based on a local commuter airline, such as Sunset Air serving closely grouped smaller Pacific Northwest cities, is situated at the opposite end of the game board 10.

While a Western United States (including Alaska) motif has been illustrated, it will be appreciated that any geographical designations could be used. The only requirement is that the geographical locations on the destination and situation spaces be relatively distant, while the geographical locations on the commuter location spaces 24 be relatively proximate.

Figure 11:
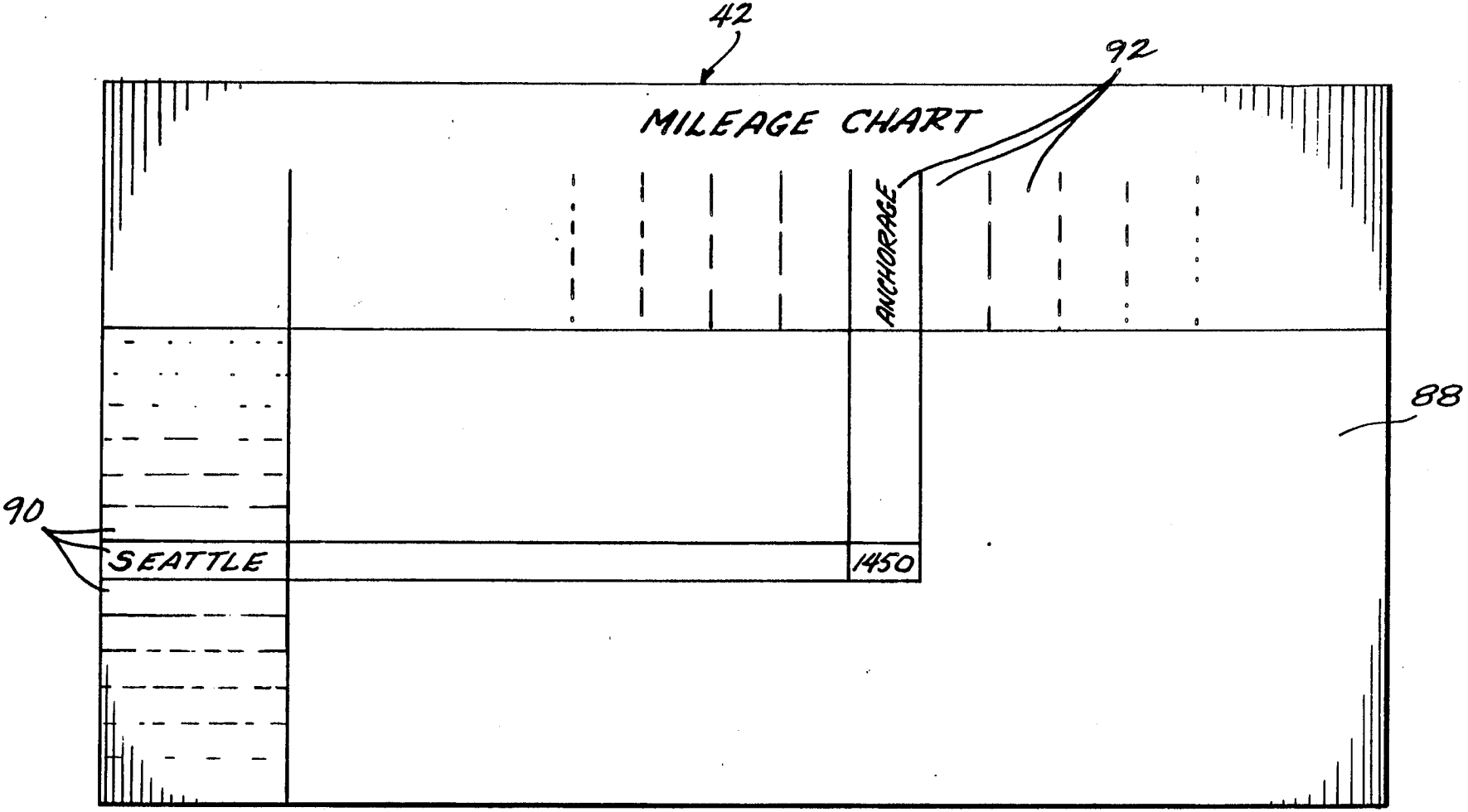
FIG. 11 is a schematic view of a mileage chart used in the airline travel board game.

The mileage chart 42 (see FIG. 11) contains a grid 88 of bonus mileage that is earned when a player moves from an interconnected space 18 bearing the name of a city (i.e., a destination or situation space) to another interconnected space 18 bearing the name of a city. A series of rows 90 containing each of the destination and situation space cities extends across one axis of the grid 88, while a series of columns 92 containing the same cities extends across the other axis of the grid. The bonus mileage awarded when moving from one city to another is found at their intersection on the grid 88. For example, 1450 bonus miles would be awarded when travelling from Seattle to Anchorage, or vice versa. The bonus mileage need not correspond to actual mileage between the associated cities. Additionally, all travel to and from certain locations, such as all Mexican destinations, may be awarded a uniform number of bonus miles. The cities contained within commuter circles 22 are not listed in the mileage chart 42.

Figure 12:
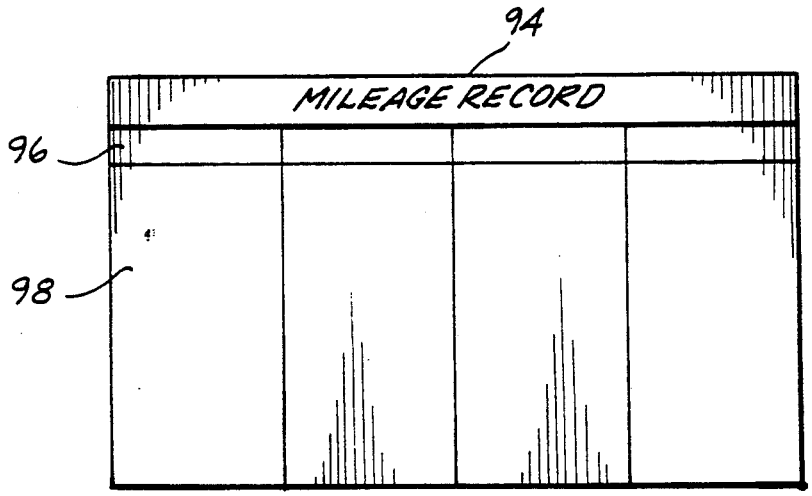
FIG. 12 illustrates a mileage record for keeping a cumulative total of airline bonus mileage for each player during play.

A mileage record 94 (see FIG. 12) is utilized to maintain each player's current total bonus mileage. The mileage record 94 is divided into four columns, with each column having a name portion 96 and a calculation portion 98. Each player's name is written in the name portion 96, and the player's current total bonus mileage is continually updated and totalled in the calculation portion 98 during play of the airline travel board game.

Figure 13:
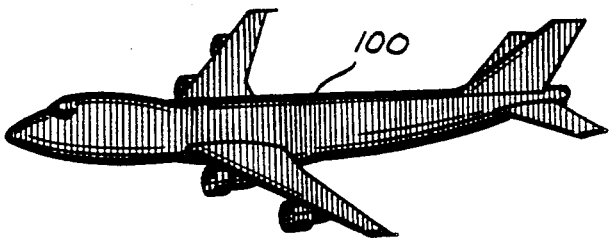
FIG. 13 illustrates a playing piece for designating a player's location on the game board shown in FIG. 1.

A playing piece 100 (see FIG. 13) is used for designating a player's position about the various spaces of the game board 10. Preferably, there are four playing pieces 100, each playing piece being colored coded to match color of one of the four home spaces 16. Also, it is preferred that the playing pieces are configured to represent an airplane. While the airline travel board game of the present invention is principally aimed at play by between two and four players, it is possible that up to eight players may play. In such a case, a home space 16 could be shared by two players and two similarly colored playing pieces 100 could be employed. If so, it is preferable that the second, but similarly colored, playing piece have a slightly different configuration so as to be distinguishable.

Figure 14:
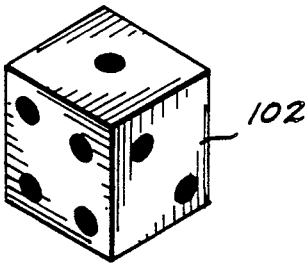
FIG. 14 illustrate a die used in the airline travel board game.

A die 102 (see FIG. 14) is used for governing play. It is the chance number generated by a roll of the die that determines the number of spaces travelled during each player's initial move. As described above, subsequent moves may be required if one of the destination cards, situation cards, commuter cards, or miscellaneous spaces so dictates. Of course, other chance number indicators may be substituted.

Figure 15:
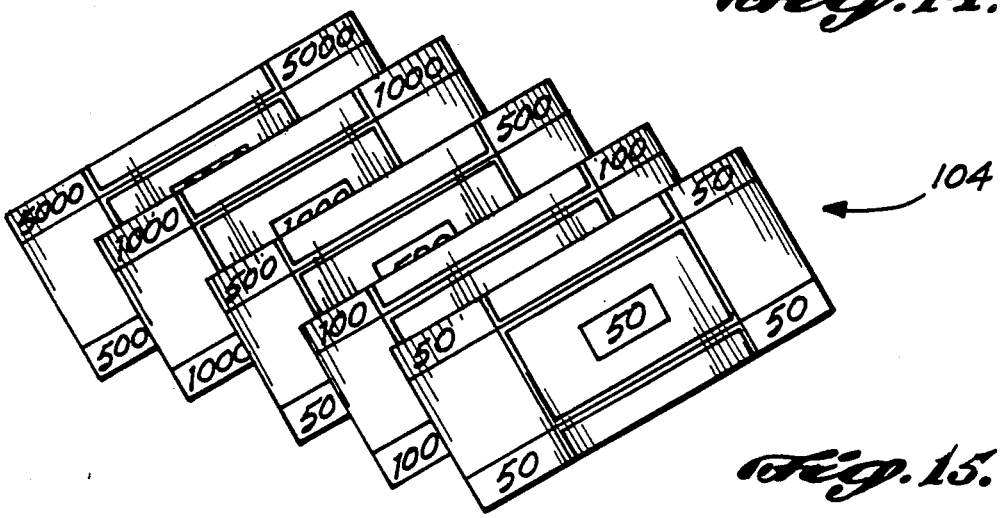
FIG. 15 illustrates playing money used to measure a player's monetary status during play.

A set of playing money 104 (see FIG. 15) is used for measuring each player's monetary status during play of the airline travel board game. While five different denominations of playing money 104 are illustrated in FIG. 15, it is only necessary that denominations and amounts of playing money sufficient to conduct play of the game be utilized. At the beginning of the game, each player is given a starting amount of playing money. The remaining amount of playing money 104 is maintained by one player, designated as the "Banker," during play. Each time a player is required to make a payment according to the directional commands of the cards or spaces of the game, it is made to the Banker and becomes part of the bank's supply of playing money. Conversely, when the directional commands of the cards or spaces dictate that a player is to receive money, other than that to be received from other players, payment is made from the bank's supply of money by the Banker.

PLAYING THE GAME

Before play begins, each player is given $2,500 in playing money 104 to be used for expenses imposed by cards drawn and by spaces landed upon. Each player selects a colored playing piece 100 associated with one of the four home spaces 16 on the game board 10, and then makes a preliminary roll of the die 102. The player rolling the highest number will initiate formal play of the game.

The first player rolls the die 102 and moves his playing piece 100 a corresponding number of spaces, the first move originating from his home space 16. This process is repeated by the players in a clockwise order around the game board 10, subject to the various rules outlined below, until one of the players has won the game.

If, after rolling the die, a player's playing piece 100 is directed to a colored interconnected space 18 (i.e., a destination, situation, or commuter space), an associated destination, situation, or commuter card is drawn and the instructions printed on the card are followed. As described above, the card may dictate a change in position on the game board 10 for the player drawing the card. The card may also instruct the player drawing the card to send another player to a different position on the game board 10. Additionally, the card may dictate a change in monetary status or a change in total bonus mileage for any player. Changes in monetary status should be transacted by the Banker, unless the card directs that the money exchange is to occur between players. If the card instructs any player to collect bonus miles, these miles are recorded and a current total is maintained on the mileage record 94. A player may take only one card per turn. Thus, if the card directs the player to move his playing piece 100 to another colored space, a second card is not drawn.

If a player lands on a colored space designated as a city (i.e., a destination or situation space) and began his turn from another space designated as a city, bonus miles are awarded to the player on the basis of the mileage depicted on the mileage chart 42 for travel between the two cities. Bonus miles are recorded and totalled on the mileage record 94, thereby keeping a current running total of each player's bonus mileage during play. Bonus miles may be cashed in for money at any time at an exchange rate of $1.00 per two bonus miles.

In addition to the colored spaces, a player may land on a number of noncolored miscellaneous spaces that direct that player to move to another position on the game board 10. For example, the player may land on a space bearing the directional command "Go To Holding Pattern" (see space 64 in FIG. 3). The player must then go to the holding pattern 36 in the center of the game board 10 and remain there for as many turns as it takes to roll an odd number with the die 102. When this happens, the holding pattern may be exited via either holding pattern exit space 40. The holding pattern 36 cannot, however, be used as a shortcut between the sides of the game board 10 for a player not specifically directed to the holding pattern or not landing on a holding pattern entrance space 38. Further, a player may land on a number of noncolored miscellaneous spaces that dictate a change in that player's total bonus mileage (see spaces 52, 58, and 66 in FIG. 3).

When a player lands on a commuter circle entrance space 26, known as a "Commuter Counter," the player must enter and travel around the full commuter circle 22 before returning to the interconnected spaces 18 of the game board 10. As mentioned above, the cities contained within the commuter circles 22 are not listed in the mileage chart 42. Rather, when the commuter trip is finished, 500 bonus miles are collected. If a player is directed to a commuter location space 24 within the commuter circle 22, rather than entering the commuter circle through commuter circle entrance space 26, the player must only complete the partial revolution around the commuter circle before being allowed to exit. Upon exit, however, no bonus miles are awarded unless the directional command on the commuter card that sent the player to the commuter location space 24 indicates otherwise. No bonus miles are awarded when a player is transferred from a commuter location space 24 within the commuter circle 22 to a new destination on the board.

If a player lands on a space that someone else is occupying, the player may send the previous occupant back to the nearest Boardroom space. However, such an action is purely discretionary. A player may have strategic reasons for not sending the previous occupant back to the Boardroom space.

To win the game, a player must accumulate 20,000 bonus miles and return to his home space 16. If the player overshoots his home space, another full revolution around the game board 10 and another attempt at landing on the home space must be made. Alternatively, a player can win the game by accumulating 50,000 bonus miles, regardless of position on the game board 10. A player must, at all times, have money to remain in the game. Any amount of money, even a nominal amount, will suffice. If a player goes broke during play, he must drop out of the game. However, as mentioned above, bonus miles may be cashed in for money at any time at an exchange rate of $1.00 per two bonus miles.

While a preferred embodiment of the present invention has been illustrated and described, it should be understood that a virtually endless number of variations could be made to the structural and playing aspects of the present invention without departing from the spirit and scope of the invention. For example, the mileage chart need not be situated on the game board in either an integral or nonintegral fashion. Rather, the mileage chart could be housed away from the game board, or several mileage charts could be utilized with each player having his own mileage chart. Additionally, the direction of play around the game board could be altered, or the number of bonus miles required to win the game could be changed. Further, the rules of play could dictate that a player can win only by landing on his own home space with the requisite amount of mileage. Accordingly, it is to be understood that the invention is not to be limited to the specific embodiment illustrated and described. Rather, the true scope and spirit of the invention is to be determined by reference to the following claims.

The embodiments of the invention in which an exclusive property or privilege is claimed are defined as follows:

1. A game apparatus for use by at least two players to accumulate bonus mileage and monetary status, the game apparatus comprising:

a game board having a playing surface provided with a plurality of principal spaces positioned thereon, said principal spaces defining a principal route of travel on said playing surface, some of said principal spaces bearing the names of relatively distant geographical locations and some of said principal spaces bearing directional commands;

at least one commuter circle positioned upon said playing surface having a commuter circle entrance space contiguous with said principal spaces, a commuter circle exit space contiguous with said principal spaces, and a plurality of commuter location spaces displaced from said principal spaces, each of said commuter location spaces bearing the name of a separate relatively proximate geographical location;

a holding pattern positioned upon said playing surface having a holding pattern entrance space contiguous with said principal spaces, a holding pattern exit space contiguous with said principal spaces, and a holding pattern region displaced from said principal spaces;

a plurality of playing pieces movable between said spaces provided on said game board, one of said playing pieces being associated with each player to designate the player's position about said spaces of said game board;

a chance number indicator for use by each player to indicate a chance number that may determine the movement of a player's playing piece;

playing money for measuring a player's monetary status;

a plurality of instruction cards associated with certain of said spaces of said game board, one of said instruction cards to be drawn by a player under certain conditions;

a mileage chart for calculating bonus mileage earned by a player when the player's playing piece is moved from a space bearing the name of a geographical location to another space bearing the name of a geographical location; and a mileage record for keeping each player's current total bonus mileage.

2. The game apparatus of claim 1, wherein said principal spaces of said game board comprise:

destination spaces identified as such, each of said destination spaces bearing the name of a separate geographical location;

situation spaces identified as such, each of said situation spaces bearing the name of a separate geographical location, said destination spaces and said situation spaces being randomly situated about said game board;

home spaces upon which said playing pieces are initially positionable, each of said home spaces identified as such and bearing the name of a separate geographical location;

commuter spaces identified as such and bearing a directional command; and miscellaneous spaces identified as such and bearing a directional command.

3. The game apparatus of claim 2, wherein said instruction cards comprise:

a deck of destination cards identified as such, one of said destination cards to be drawn by a player when the player's playing piece is moved to one of said destination spaces in response to a chance number indicated by said chance number indicator, most of said destination cards dictating at least one action selected from the group consisting of changing the position of one of said playing pieces associated with one of said players on said game board, changing a player's monetary status, and changing a player's total bonus mileage;

a deck of situation cards identified as such, one of said situation cards to be drawn by a player when the player's playing piece is moved to one of said situation spaces in response to a chance number indicated by said chance number indicator, most of said situation cards dictating at least one action selected from the group consisting of changing the position of one of said playing pieces associated with one of said players on said game board, changing a player's monetary status, and changing a player's total bonus mileage; and a deck of commuter cards identified as such, one of said commuter cards to be drawn by a player when the player's playing piece is moved to one of said commuter spaces in response to a chance number indicated by said chance number indicator, most of said commuter cards dictating at least one action selected from the group consisting of directing one of said playing pieces associated with one of said players to said commuter circle, changing a player's monetary status, and changing a player's total bonus mileage.

4. The game apparatus of claim 3, wherein said destination spaces and said destination cards bear a first color, said situation spaces and said situation cards bear a second color, and said commuter spaces and said commuter cards bear a third color.

5. The game apparatus of claim 2, wherein said home spaces and said playing pieces are color coded so that for each of said home spaces there is a corresponding playing piece of the same color.

6. The game apparatus of claim 2, wherein said game board is substantially rectangular and has four corners, and wherein there are four of said home spaces situated in said four corners of said game board.

7. The game apparatus of claim 1, wherein said principal spaces are arranged on said playing surface of said game board in a pattern roughly resembling a floor plan of an airline terminal.

8. The game apparatus of claim 1, wherein said playing pieces are configured to represent airplanes.

9. The game apparatus of claim 1, wherein said chance number indicator is a die.

10. The game apparatus of claim 1, wherein said mileage chart is integral with said game board.

11. The game apparatus of claim 1, wherein said geographical locations are cities.

12. A game apparatus for use by at least two players in which bonus mileage and monetary status are accumulated, the game apparatus comprising:

a game board having a playing surface;

a plurality of movable playing pieces, one of said playing pieces being associated with each player to designate the player's position on said game board;

a first set of spaces randomly situated about said playing surface of said game board, each of said first set of spaces bearing the name of a separate relatively distant geographical location;

at least one commuter circle situated on said playing surface of said game board, said at least one commuter circle having a commuter circle entrance space contiguous with said first set of spaces, a commuter circle exit space contiguous with said first set of spaces, and a plurality of commuter location spaces displaced from said first set of spaces, each of said commuter location spaces bearing the name of a separate relatively proximate geographical location; and commuter spaces randomly situated about said playing surface of said game board, said commuter spaces including instructions for directing one of said playing pieces associated with one of said players to a commuter location space within said at least one commuter circle.

* * * * *